US011377296B2

(12) United States Patent
Bischoff et al.

(10) Patent No.: US 11,377,296 B2
(45) Date of Patent: Jul. 5, 2022

(54) PACKAGING BRACE FOR A WASHING MACHINE APPLIANCE

(71) Applicant: Haier US Appliance Solutions, Inc., Wilmington, DE (US)

(72) Inventors: Stephen Michael Bischoff, Louisville, KY (US); Austin Colby Specter, Pensacola, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 415 days.

(21) Appl. No.: 16/679,595

(22) Filed: Nov. 11, 2019

(65) Prior Publication Data

US 2021/0139230 A1 May 13, 2021

(51) Int. Cl.

| | |
|---|---|
| ***B65D 85/68*** | (2006.01) |
| ***D06F 39/00*** | (2020.01) |
| ***B65D 85/64*** | (2006.01) |
| ***B65D 5/20*** | (2006.01) |
| ***B65D 5/42*** | (2006.01) |

(52) U.S. Cl.

CPC ..... *B65D 85/68* (2013.01); *B65D 5/2033* (2013.01); *B65D 5/2047* (2013.01); *B65D 5/4266* (2013.01); *B65D 85/64* (2013.01); *D06F 39/001* (2013.01); *B65D 2581/053* (2013.01); *B65D 2585/6855* (2013.01)

(58) Field of Classification Search

CPC ..... B65D 5/20; B65D 5/2033; B65D 5/2047; B65D 5/42; B65D 5/4266; B65D 81/02; B65D 85/64; B65D 85/68; B65D 2581/053; B65D 2585/6855; D06F 37/24; D06F 39/00; D06F 39/001

USPC ..... 206/320, 588, 591–594

See application file for complete search history.

(56) References Cited

U.S. PATENT DOCUMENTS

| | | | | |
|---|---|---|---|---|
| 3,620,365 | A | 11/1971 | Elwell et al. | |
| 3,809,232 | A | 5/1974 | Brennan | |
| 3,812,959 | A | 5/1974 | Brennan | |
| 4,362,266 | A | 12/1982 | Webinger | |
| 4,754,914 | A * | 7/1988 | Wischusen, III | B65D 75/14 229/87.08 |
| 4,832,190 | A | 5/1989 | Favreau | |
| 6,997,323 | B2 * | 2/2006 | Maresh | B65D 5/5069 206/592 |
| 7,014,160 | B2 * | 3/2006 | Muyskens | D06F 39/001 206/592 |
| 7,648,031 | B2 * | 1/2010 | Kari | B65D 81/05 206/592 |
| 7,731,033 | B2 * | 6/2010 | Sattora | B65D 5/5035 206/592 |
| 7,856,796 | B2 | 12/2010 | Trebilcock et al. | |
| 9,540,158 | B1 | 1/2017 | Fox | |

(Continued)

*Primary Examiner* — Bryon P Gehman

(74) *Attorney, Agent, or Firm* — Dority & Manning, P.A.

(57) ABSTRACT

A method of forming a packaging brace for a washing machine appliance includes providing a flat blank. The method also includes folding a left side panel and a right side panel of the flat blank inwards towards each other. The method further includes positioning a bottom panel of the blank above an opening in a cabinet of the washing machine and inserting the bottom panel into a basket of the washing machine through the opening whereby a contoured profile of the opening urges the blank to fold and form a packaging brace for the washing machine appliance.

19 Claims, 8 Drawing Sheets

(56) References Cited

U.S. PATENT DOCUMENTS

| | | | | |
|---|---|---|---|---|
| 9,670,611 | B2 | 6/2017 | Senn et al. | |
| 9,790,634 | B2 | 10/2017 | Senn et al. | |
| 2008/0168803 | A1* | 7/2008 | Muyskens ..... | D06F 39/001 68/23.3 |
| 2011/0240498 | A1 | 10/2011 | Trebilcock | |

* cited by examiner

PACKAGING BRACE FOR A WASHING MACHINE APPLIANCE

FIELD OF THE INVENTION

The present subject matter relates generally to braces for packaging and/or shipping washing machine appliances.

BACKGROUND OF THE INVENTION

Washing machine appliances generally include an apron or cabinet. A tub that contains wash fluid during operation of the washing machine appliance is mounted within the cabinet. A basket within the tub holds articles for washing and is rotatable within the tub while washing the articles. To reduce noisy vibrations when the basket spins within the tub, the tub is suspended on the cabinet such that the tub is movable relative to the cabinet. However, movement of the basket relative to the tub or movement of the basket and tub relative to the cabinet can be problematic while shipping the washing machine appliance.

After manufacture, the washing machine appliance is generally packaged within a shipping box. The shipping box can limit damage to the washing machine appliance during transit. However, known shipping boxes suffer various drawbacks. For example, such shipping boxes do not include features for constraining the basket and tub relative to each other or the cabinet. Thus, a packaging brace may be provided to constrain such relative movement. However, known packaging braces are typically complex in construction and/or formation, e.g., known packaging braces typically include multiple discrete pieces which must be assembled, and may require additional steps for assembly, such as interlocking various pieces of the packaging brace, applying adhesives, and so forth.

Thus, a packaging brace for a washing machine appliance which is relatively simple in construction and easy to form would be desirable.

BRIEF DESCRIPTION OF THE INVENTION

Aspects and advantages of the invention will be set forth in part in the following description, or may be apparent from the description, or may be learned through practice of the invention.

In an example embodiment, a flat blank for forming a packaging brace for a washing machine appliance is provided. The flat blank includes a bottom panel, a left side panel directly joined to a left side of the bottom panel at a first seam, a back panel directly joined to a back side of the bottom panel at a second seam, a right side panel positioned opposite the left side panel and directly joined to a right side of the bottom panel at a third seam, and a front panel positioned opposite the back panel and directly joined to a front side of the bottom panel at a fourth seam. The flat blank also includes a first corner segment directly joined to the left side panel at a fifth seam and directly joined to the back panel at a sixth seam. The first corner segment is configured to define a first corner of the packaging brace when the flat blank is folded such that the fifth seam and the sixth seam are generally aligned with each other and in contact with each other. The flat blank also includes a second corner segment directly joined to the back side panel at a seventh seam and directly joined to the right side panel at an eighth seam. The second corner segment is configured to define a second corner of the packaging brace when the flat blank is folded such that the seventh seam and the eighth seam are generally aligned with each other and in contact with each other. The flat blank also includes a third corner segment directly joined to the right side panel at a ninth seam and directly joined to the front panel at a tenth seam. The third corner segment is configured to define a third corner of the packaging brace when the flat blank is folded such that the ninth seam and the tenth seam are generally aligned with each other and in contact with each other. The flat blank also includes a fourth corner segment directly joined to the front panel at an eleventh seam and directly joined to the left side panel at a twelfth seam. The fourth corner segment is configured to define a fourth corner of the packaging brace when the flat blank is folded such that the eleventh seam and the twelfth seam are generally aligned with each other and in contact with each other. The first corner, the second corner, the third corner, and the fourth corner of the packaging brace are configured to contact an opening in a cabinet of the washing machine appliance at a first set of four contact points and to contact a basket of the washing machine appliance at a second set of four contact points.

In another example embodiment, a method of forming a packaging brace for a washing machine appliance is provided. The method includes providing a flat blank. The flat blank includes a bottom panel, a left side panel directly joined to a left side of the bottom panel at a first seam, a back panel directly joined to a back side of the bottom panel at a second seam, a right side panel positioned opposite the left side panel and directly joined to a right side of the bottom panel at a third seam, and a front panel positioned opposite the back panel and directly joined to a front side of the bottom panel at a fourth seam. The flat blank also includes a first corner segment directly joined to the left side panel at a fifth seam and directly joined to the back panel at a sixth seam. The flat blank further includes a second corner segment directly joined to the back side panel at a seventh seam and directly joined to the right side panel at an eighth seam. The flat blank also includes a third corner segment directly joined to the right side panel at a ninth seam and directly joined to the front panel at a tenth seam. The flat blank further includes a fourth corner segment directly joined to the front panel at an eleventh seam and directly joined to the left side panel at a twelfth seam. The method also includes folding the left side panel and the right side panel of the flat blank inwards towards each other. The method further includes positioning the bottom panel above an opening in a cabinet of the washing machine and inserting the bottom panel into a basket of the washing machine through the opening such that a contoured profile of the opening urges the blank to fold. As a result, the fifth seam and the sixth seam are generally aligned with each other and in contact with each other to define a first corner of the packaging brace, the seventh seam and the eighth seam are generally aligned with each other and in contact with each other to define a second corner of the packaging brace, the ninth seam and the tenth seam are generally aligned with each other and in contact with each other to define a third corner of the packaging brace, and the eleventh seam and the twelfth seam are generally aligned with each other and in contact with each other to define a fourth corner of the packaging brace. The first corner, the second corner, the third corner, and the fourth corner of the packaging brace are in contact with the opening in the cabinet of the washing machine appliance at a first set of four contact points and in contact with the basket of the washing machine appliance at a second set of four contact points.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
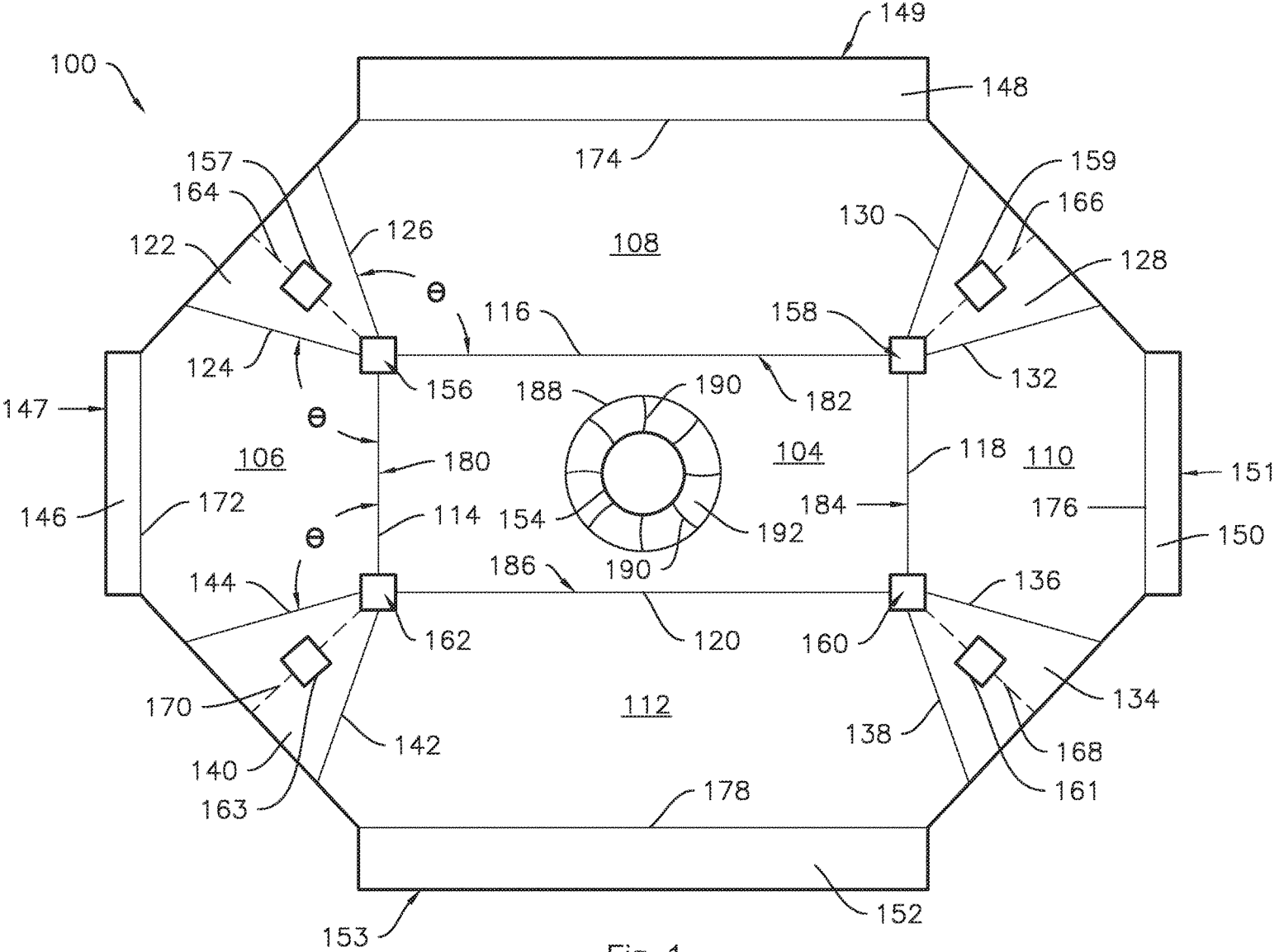
FIG. 1 is a view of a flat blank for forming a packaging brace for a washing machine appliance according to one or more example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "first," "second," and "third" may be used interchangeably to distinguish one component from another and are not intended to signify location or importance of the individual components.

Figure 2:
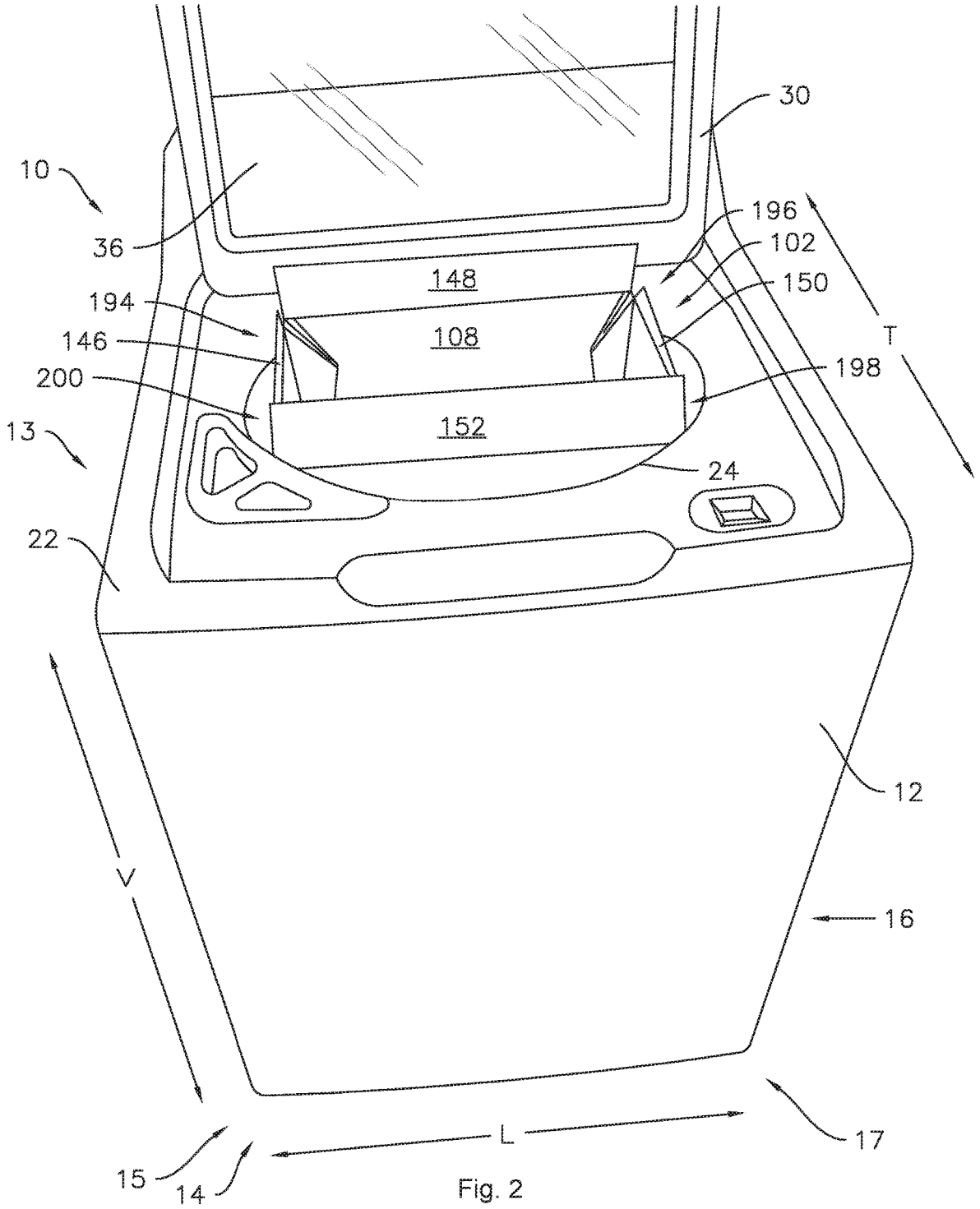
FIG. 2 is a perspective view of a washing machine appliance with a packaging brace formed from the flat blank of FIG. 1.
Figure 3:
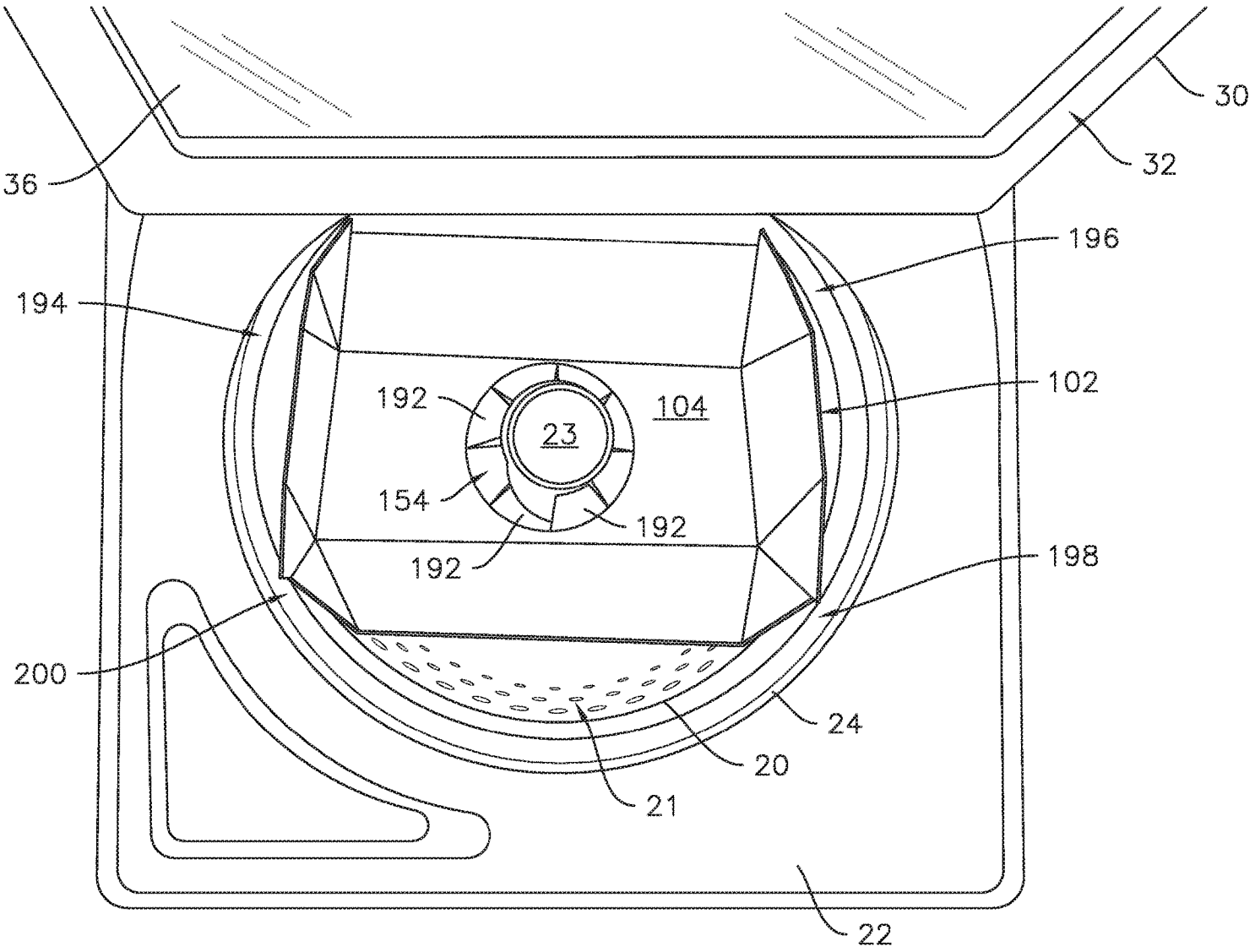
FIG. 3 is a top down view of the washing machine appliance and packaging brace of FIG. 2.
Figure 4:
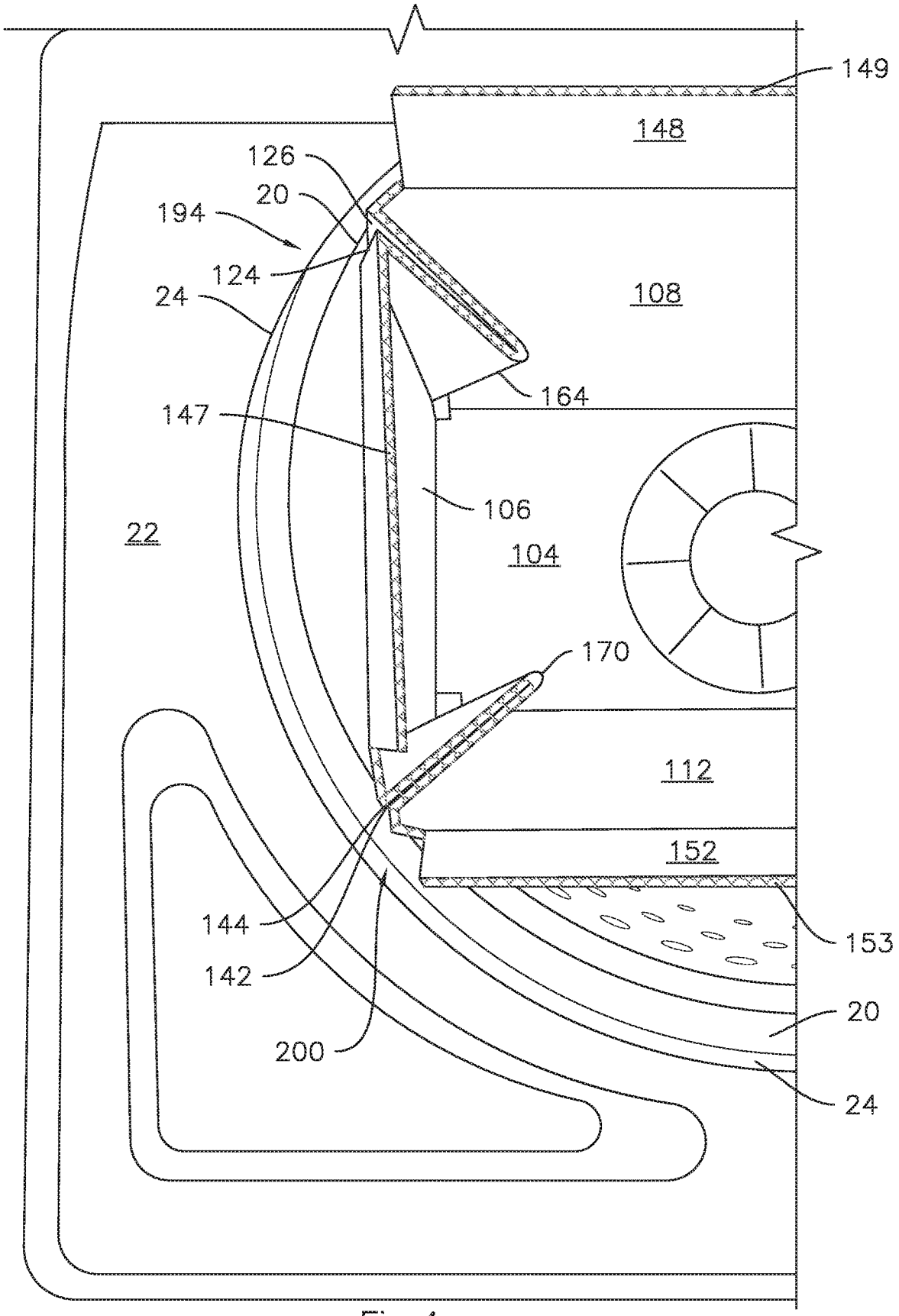
FIG. 4 is an enlarged view of a portion of FIG. 3.
Figure 5:
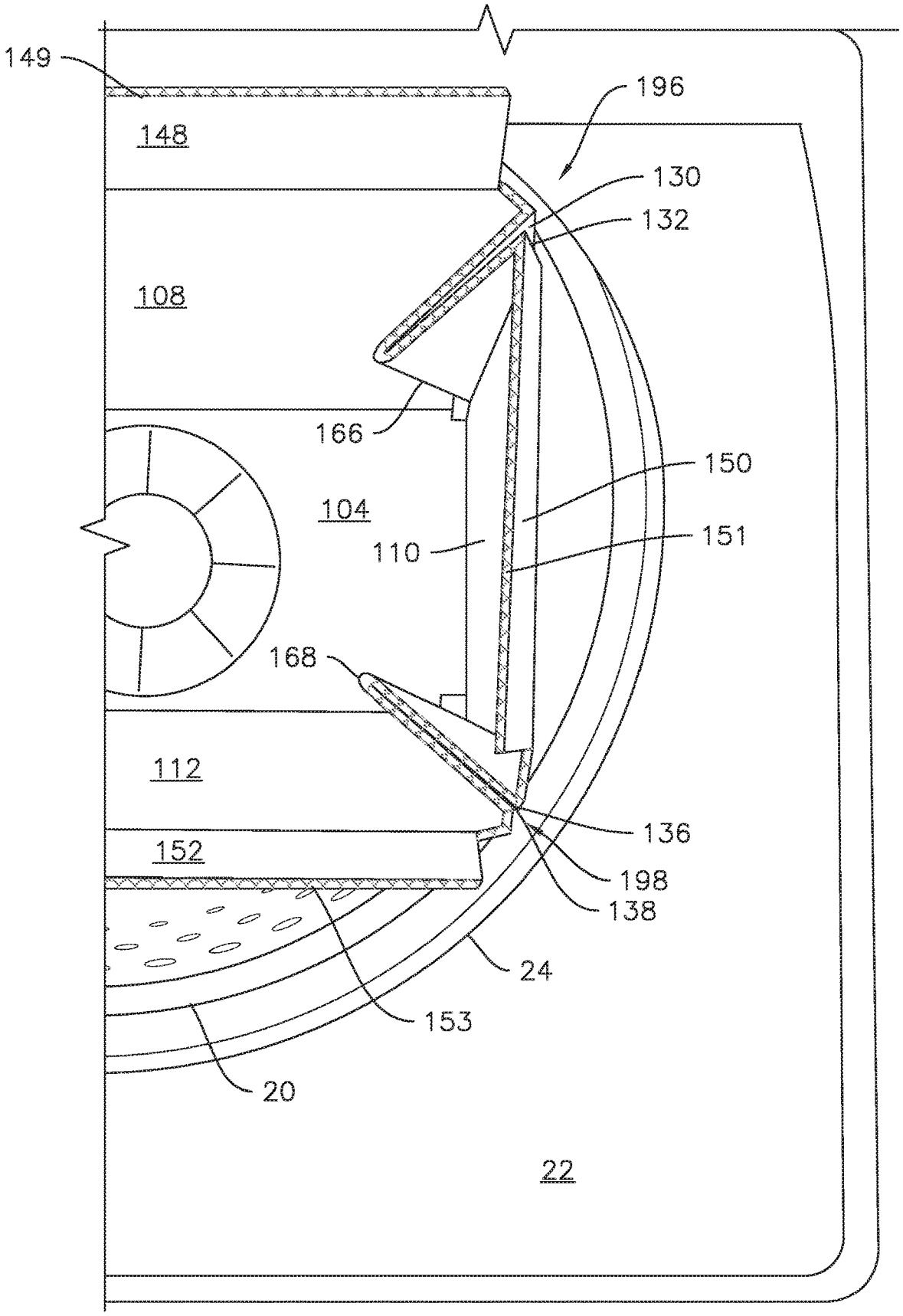
FIG. 5 is another enlarged view of another portion of FIG. 3.

Turning briefly to FIGS. 2 and 3, the washing machine appliance 10 defines a vertical direction V, a lateral direction L, and a transverse direction T. The vertical direction V, lateral direction L, and transverse direction T are mutually perpendicular and form an orthogonal direction system. Washing machine appliance 10 has a cabinet 12 that extends between a top portion 13 and a bottom portion 14 along the vertical direction V. Cabinet 12 also extends between a first side portion 15 and a second side portion 16, e.g., along the lateral direction L, and a front portion 17 and a back portion (not shown), e.g., along the transverse direction T. The first side portion 15 may be a left side portion and the second side portion 16 may be a right side portion, e.g., from the perspective of a user standing in front of the washing machine appliance 10.

A wash basket 20 is rotatably mounted within cabinet 12, e.g., within a wash tub (not shown) disposed within cabinet 12. A motor (not shown) is in mechanical communication with wash basket 20 in order to selectively rotate wash basket 20, e.g., during an agitation or a rinse cycle of washing machine appliance 10. Wash basket 20 defines a wash chamber 21 that is configured for receipt of articles for washing. In some embodiments, an agitator 23 or impeller (not shown) extends from wash basket 20 into wash chamber 21. The agitator 23 assists agitation of articles disposed within wash chamber 21 during operation of washing machine appliance 10.

In some exemplary embodiments, e.g., as illustrated in FIGS. 2 and 3, cabinet 12 of washing machine appliance 10 has a top panel 22 positioned at or adjacent top portion 13 of cabinet 12. Top panel 22 defines an opening 24 that permits user access to wash chamber 21 of wash basket 20. Lid 30 is rotatably mounted to top panel 22 and includes an inner surface 32 which faces the wash basket 20 when the lid 30 is closed. However, alternatively, lid 30 may be mounted to cabinet 12 or any outer suitable support. Further alternate exemplary embodiments may include an opening defined in a front panel of washing machine 10, e.g., in exemplary embodiments wherein washing machine 10 is a horizontal axis washing machine. Lid 30 selectively rotates between a closed position (not shown) and the open position shown in FIGS. 2 and 3. In the closed position, lid 30 inhibits access to wash chamber 21. Conversely, in the open position, a user can access wash chamber 21. An aperture 36 in lid 30 permits viewing of wash chamber 21 when lid 30 is in the closed position, e.g., during operation of washing machine appliance 10. Lid 30 also includes a handle (not shown) that, e.g., a user may pull and/or lift when opening and closing lid 30.

FIG. 1 is top view of a blank 100 for forming a packaging brace 102 for a washing machine appliance 10 (FIG. 2) according to one or more example embodiments of the present subject matter. The blank 100 may be referred to herein as a "flat blank" in that the blank 100 is generally stored and/or transported in a flat state prior to use, e.g., forming into a packaging brace 102 and installation into a washing machine appliance. That is, it should be understood that the term "flat blank" refers to the blank 100 in a flat condition, and the terms blank or flat blank may be used interchangeably in at least some contexts herein. As discussed in greater detail below, the flat blank 100 may be used for forming a packaging brace 102 which is useful in packaging for a washing machine appliance, in particular a vertical axis washing machine appliance, to reduce damage to the washing machine appliance during transit. Packaging brace 102 may be used in or with any suitable vertical axis washing machine appliance.

The flat blank 100 may be formed from a corrugated sheet, e.g., of plastic, cardboard or fiberboard, or other suitable material. As will be understood, the corrugated sheet has flutes that extend longitudinally within the corrugated sheet. For example, the corrugated sheet may be formed from a fluted corrugated board and one or two flat linerboards, and the fluted corrugated board may define flutes within the corrugated sheet. Corrugated sheets are well understood by those skilled in the art and are not described in detail herein.

As generally shown in FIG. 1, the blank 100 may include a plurality of sections, e.g., panels and/or flaps, as will be described in more detail below, and such sections may bend relative to one another. For example, the sections of the blank 100 may be bendable along seams or score or fold lines.

In particular, in the example embodiment illustrated in FIG. 1, the blank 100 may include a bottom panel 104, a left side panel 106 directly joined to a left side 180 of the bottom panel 104 at a first seam 114, a back panel 108 directly joined to a back side 182 of the bottom panel 104 at a second seam 116, and a right side panel 110 positioned opposite the left side panel 106. As illustrated for example in FIG. 1, the right side panel 110 may be directly joined to a right side 184 of the bottom panel 104 at a third seam 118. The blank 100 may also include a front panel 112, e.g., positioned opposite the back panel 108. For example, the front panel 112 may be directly joined to a front side 186 of the bottom panel 104 at a fourth seam 120.

Still referring to FIG. 1, the blank 100 may also include a plurality of corner segments. For example, the plurality of corner segments may include a first corner segment 122, a second corner segment 128, a third corner segment 134, and a fourth corner segment 140. As illustrated in FIG. 1, the first corner segment 122 may be directly joined to the left side panel 106 at a fifth seam 124 and directly joined to the back panel 108 at a sixth seam 126. The second corner segment 128 may be directly joined to the back side panel 108 at a seventh seam 130 and directly joined to the right side panel 110 at an eighth seam 132. The third corner segment 134 may be directly joined to the right side panel 110 at a ninth seam 136 and directly joined to the front panel 112 at a tenth seam 138. The fourth corner segment 140 may be directly joined to the front panel 112 at an eleventh seam 142 and directly joined to the left side panel 106 at a twelfth seam 144.

As illustrated in FIGS. 2 through 7, the first corner segment 122 may be configured to define a first corner 194 of the packaging brace 102 when the blank 100 is folded such that the fifth seam 124 and the sixth seam 126 are generally aligned with each other and in contact with each other. As used herein, "generally aligned" is intended to include alignments within ten degrees (10°) of parallel to each other in any direction (e.g., clockwise or counterclockwise). The second corner segment 128 may be configured to define a second corner 196 of the packaging brace 102 when the blank 100 is folded such that the seventh seam 130 and the eighth seam 132 are generally aligned with each other and in contact with each other. The third corner segment 134 may be configured to define a third corner 198 of the packaging brace 102 when the blank 100 is folded such that the ninth seam 136 and the tenth seam 138 are generally aligned with each other and in contact with each other. The fourth corner segment 140 may be configured to define a fourth corner 100 of the packaging brace 102 when the blank 100 is folded such that the eleventh seam 142 and the twelfth seam 144 are generally aligned with each other and in contact with each other.

As generally illustrated in FIGS. 2 through 7, the first corner 194, the second corner 196, the third corner 198, and the fourth corner 200 of the packaging brace 102 are configured to contact the opening 24 in the cabinet 12 of the washing machine appliance 10 at a first set of four contact points 202, 204, 206, and 208 and to contact the basket 20 of the washing machine appliance 10 at a second set of four contact points 210, 212, 214, and 216. In at least some exemplary embodiments, each contact point of the first set of contact points may be vertically aligned with a corresponding contact point of the second set of contact points, e.g., each contact point of the first set of four contact points may be positioned directly above the corresponding contact point of the second set of four contact points. For example, the first corner 194 may contact the opening 24 at a first contact point 202 and the basket 20 at a fifth contact point 210, where the first contact point 202 is vertically aligned with the fifth contact point 210 directly above the fifth contact point 210. The second corner 196 may contact the opening 24 at a second contact point 204 and the basket 20 at a sixth contact point 212, where the second contact point 204 is vertically aligned with the sixth contact point 212 directly above the sixth contact point 212. The third corner 198 may contact the opening 24 at a third contact point 206 and the basket 20 at a seventh contact point 214, where the third contact point 206 is vertically aligned with the seventh contact point 214 directly above the seventh contact point 214. The fourth corner 200 may contact the opening 24 at a fourth contact point 208 and the basket 20 at an eighth contact point 216, where the fourth contact point 208 is vertically aligned with the eighth contact 216 point directly above the eighth contact point 216.

As best seen in FIG. 1, the blank 100 may also include a left side flap 146 directly connected to the left side panel 106 at a thirteenth seam 172, a back flap 148 directly connected to the back panel 108 at a fourteenth seam 174, a right side flap 150 opposite the left side flap 146 and directly connected to the left right panel 110 at a fifteenth seam 176, and a front flap 152 opposite the back flap 148 and directly connected to the front panel 112 at a sixteenth seam 178. The left side flap 146 may define an outer edge 147. The back flap 148 may define an outer edge 149. The right side flap 150 may define an outer edge 151. The front flap 152 may define an outer edge 153. As may be seen in FIGS. 2 through 7, the outer edge 147 of the left side flap 146, the outer edge 149 of the back flap 148, the outer edge 151 of the right side flap 150, and the outer edge 153 of the front flap 152 may each be configured to contact an inner surface 32 (FIG. 3) of the lid 30 of the washing machine appliance 10 when the blank 100 is folded to form the packaging brace 102 and installed within the washing machine appliance 10. Where, as described in more detail below, the blank 100 is folded at least in part during installation into the washing machine appliance 10, e.g., due to interaction with the curved profile of the top panel 22 and opening 24 therein, it should be understood that references herein to "when the blank 10 is folded" and/or "when the packaging brace 102 is formed" include the packaging brace 102 having been installed in the washing machine appliance 10 because such installation is also part of the folding process and/or the process of the forming the packaging brace 102.

As mentioned, the blank 100 and the resultant packaging brace 102 formed therefrom may be used with a variety of washing machine appliances. For example, in some embodiments, the blank 100 may include an aperture 154 defined in the bottom panel 104. As may be seen in FIG. 3, the aperture 154 may be configured to receive an agitator 23 of the washing machine appliance 10. For example, the aperture 154 may be defined by curved inner edges of a plurality of fingers 192 in the bottom panel 104 of the blank 100. For example, the bottom panel 104 may include the aperture 154 defined therein and a plurality of radial slits 190 originating from the aperture 154 may also be provided in the bottom panel 104, whereby the plurality of fingers 192 are each defined between adjacent slits 190. An outer boundary of the fingers 192 may be defined by a round seam 188 which extends around the aperture 154 and is generally concentric with the aperture 154. As used herein, "generally," means within 10% of, e.g., generally concentric includes the centers of the aperture 154 and the round seam 188 may be offset from one another in any direction by up to 10% of the diameter (in case of a circle) or major diameter (in case of an ellipse) of the round seam 188.

The blank 100 may further include features which promote ease of folding and formation of the packaging brace 102. For example, the blank 100 may include a plurality of relief openings which aid in formation of the four corners 194, 196, 198, and 200 of the packaging brace 102. As best seen in FIG. 1, the blank 100 may include a first relief opening 156 at an intersection of the bottom panel 104, the left side panel 106, the back panel 108, and the first corner segment 122. A second relief opening 158 may be provided at an intersection of the bottom panel 104, the back panel 108, the right side panel 110, and the second corner segment 128. A third relief opening 160 may be provided at an intersection of the bottom panel 104, the right side panel 110, the front panel 112, and the third corner segment 134. A fourth relief opening 162 may be provided at an intersection of the bottom panel 104, the left side panel 106, the front panel 112, and the fourth corner segment 140.

As another example, the blank 100 may include perforated score lines in the corner segments to aid in forming the four corners 194, 196, 198, and 200 of the packaging brace 102. For example, such score lines may promote ease of bringing the respective seams at each corner segment together, e.g., bringing the fifth seam 124 and the sixth seam 126 of the first corner segment 122 into contact and alignment to form the first corner 194, etc. Thus, in some embodiments, the first corner segment 122 may be bifurcated by a first score line 164, the second corner segment 128 may be bifurcated by a second score line 166, the third corner segment 134 may be bifurcated by a third score line 168, and the fourth corner segment 140 may be bifurcated by a fourth score line 170.

In some example embodiments, the blank 100 may include additional relief openings, such as a fifth relief opening 157 positioned in the first corner segment 122, a sixth relief opening 159 positioned in the second corner segment 128, a seventh relief opening 161 positioned in the third corner segment 134, and an eighth relief opening 163 positioned in the fourth corner segment 140. For example, the fifth relief opening 157 may be located along the first score line 164, such as concentrically positioned on the first score line 164, e.g., whereby a center point of the fifth relief opening 157 is co-located with a midpoint of the first score line 164. Also by way of example, the sixth relief opening 159 may be located along the second score line 166, such as concentrically positioned on the second score line 166, the seventh relief opening 161 may be located along the third score line 168, such as concentrically positioned on the third score line 168, and the eighth relief opening 163 may be located along the fourth score line 170, such as concentrically positioned on the fourth score line 170.

Figure 6:
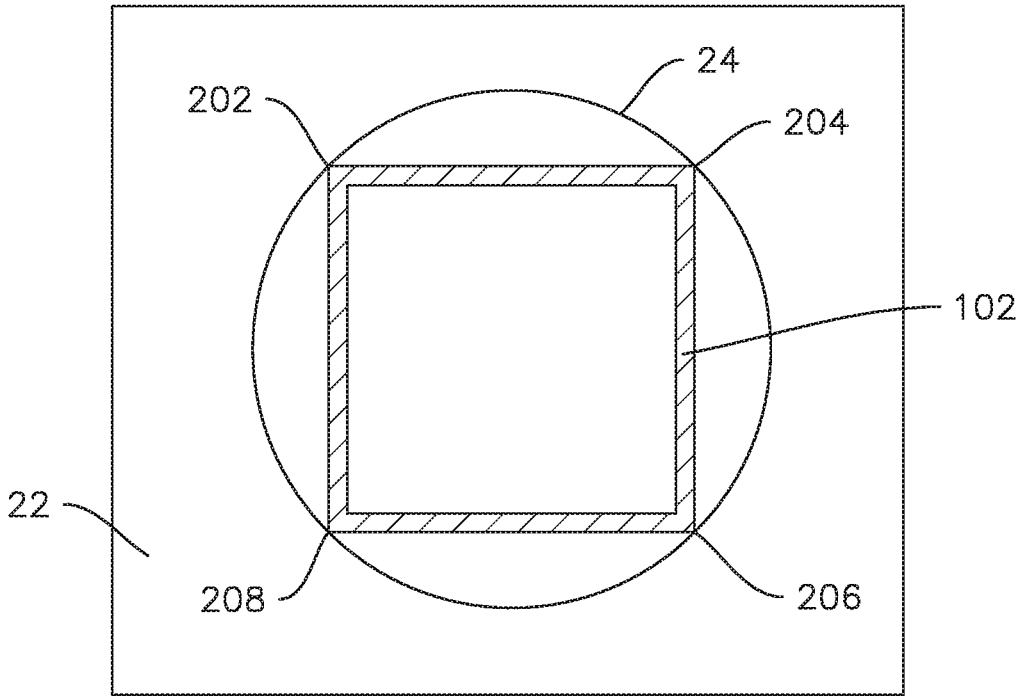
FIG. 6 provides a simplified view of a packaging brace in contact with an opening in a top panel of a washing machine appliance according to one or more example embodiments of the present subject matter.

FIG. 6 provides a simplified view of the top panel 22 and the opening 24 in the top panel 22 with the packaging brace 102 positioned within the opening 24, in order to more clearly depict the first set of four contact points 202, 204, 206, and 208. As may be seen in FIG. 6, the first set of four contact points may include a first contact point 202 where the first corner 194 of the packaging brace 102 contacts the opening 24, a second contact point 204 where the second corner 196 of the packaging brace 102 contacts the opening 24, a third contact point 206 where the third corner 198 of the packaging brace 102 contacts the opening 24, and a fourth contact point 208 where the fourth corner 200 of the packaging brace 102 contacts the opening 24.

Figure 7:
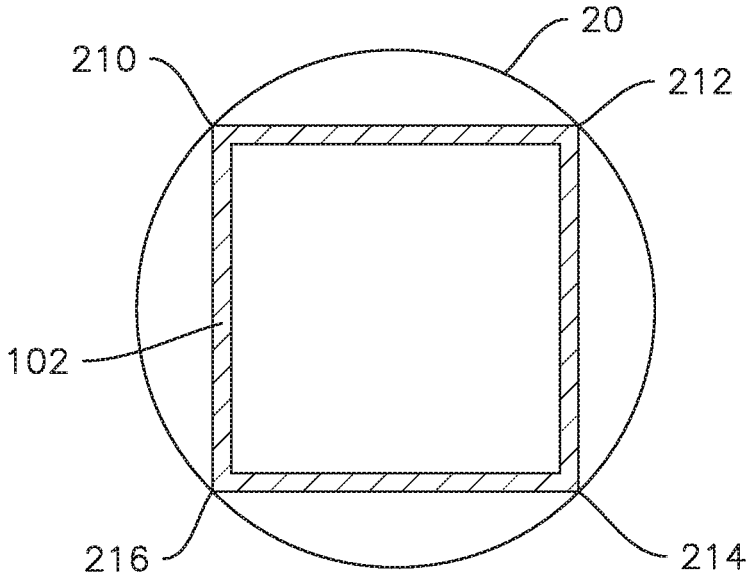
FIG. 7 provides a simplified view of a packaging brace in contact with a wash basket of a washing machine appliance according to one or more example embodiments of the present subject matter.

FIG. 7 provides a simplified view of wash basket 20 with the packaging brace 102 positioned within the wash basket 20, in order to more clearly depict the second set of four contact points 210, 212, 214, and 216. As may be seen in FIG. 7, the second set of four contact points may include a fifth contact point 210 where the first corner 194 of the packaging brace 102 contacts the wash basket 20, a sixth contact point 212 where the second corner 196 of the packaging brace 102 contacts the wash basket 20, a seventh contact point 214 where the third corner 198 of the packaging brace 102 contacts the wash basket 20, and an eighth contact point 216 where the fourth corner 200 of the packaging brace 102 contacts the wash basket 20.

Figure 8:
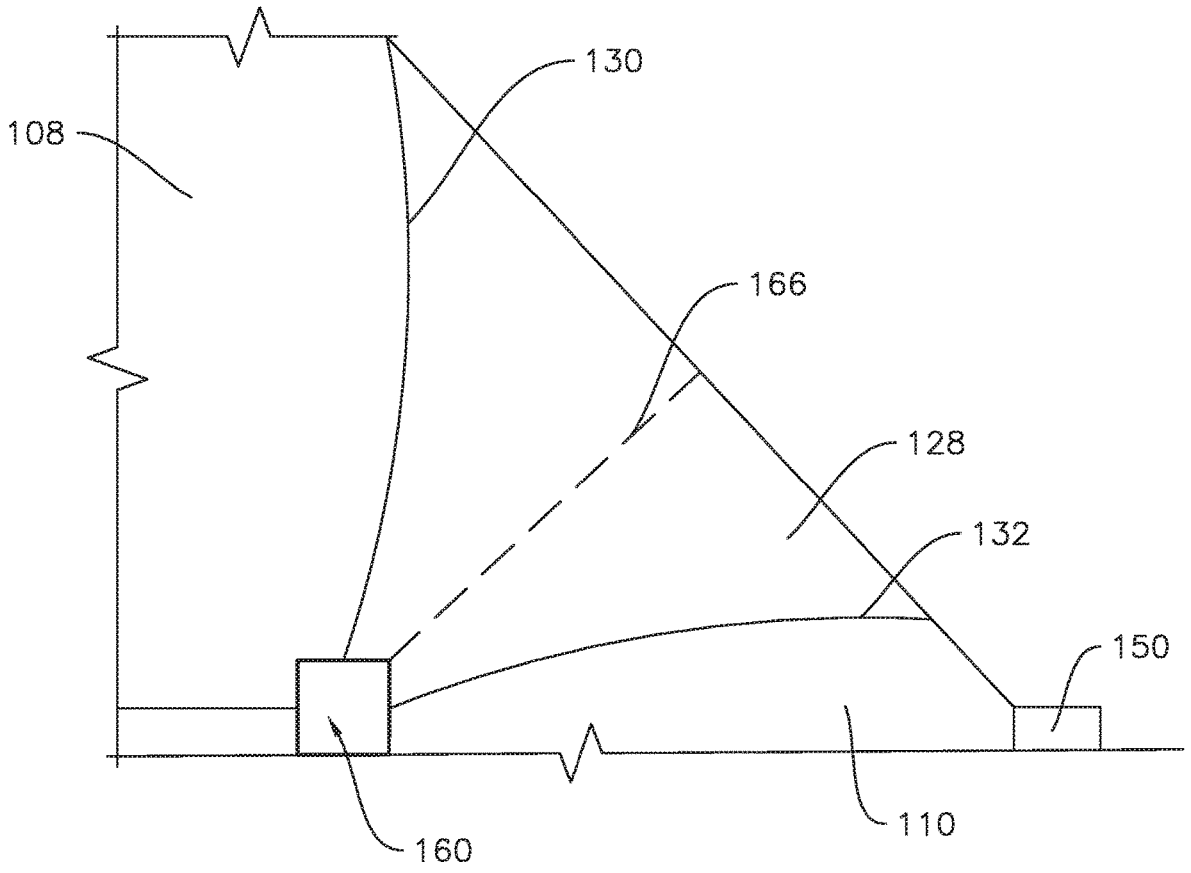
FIG. 8 is an enlarged view of a segment of a flat blank for forming a packaging brace for a washing machine appliance according to one or more additional example embodiments of the present subject matter.

In various embodiments, the seams or fold lines may be provided in any suitable form, such as straight lines or curved lines, or combinations thereof. For example, in some embodiments, e.g., as illustrated in FIG. 1, the fifth seam 124, the sixth seam 126, the seventh seam 130, the eighth seam 132, the ninth seam 136, the tenth seam 138, the eleventh seam 142, and the twelfth seam 144 may each be linear, e.g., straight lines. FIG. 8 illustrates another example embodiment, wherein the seventh seam 130 and the eighth seam 132 are curvilinear. It should be understood that, in embodiments such as that illustrated in FIG. 8, the seams defining the other corner segments 122, 134, and 140 may also be curvilinear, e.g., the fifth seam 124, the sixth seam 126, the seventh seam 130, the eighth seam 132, the ninth seam 136, the tenth seam 138, the eleventh seam 142, and the twelfth seam 144 may each be curvilinear.

As illustrated, the corner segments 122, 128, 134, and 140 may be generally triangular. As such, the sides of the corner segments 122, 128, 134, and 140 (e.g., the seams defining each corner segment) may be oriented at an angle Θ to the seams defining the bottom panel 104. As noted in FIG. 1, the angle Θ may be measured either clockwise or counterclockwise. The angle Θ may be between about ninety degrees (90°) and about one hundred ten degrees (110°). For example, the angle Θ may be about one hundred degrees (100°). Thus, in some embodiments, the fifth seam 124 may form an angle Θ of about one hundred degrees with the first seam 114, the sixth seam 126 may form an angle Θ of about one hundred degrees with the second seam 116, the seventh seam 130 may form an angle Θ of about one hundred degrees with the second seam 116, the eighth seam 132 may form an angle Θ of about one hundred degrees with the third seam 118, the ninth seam 136 may form an angle Θ of about one hundred degrees with the third seam 118, the tenth seam 138 may form an angle Θ of about one hundred degrees with the fourth seam 120, the eleventh seam 142 may form an angle Θ of about one hundred degrees with the fourth seam 120, and the twelfth seam 144 may form an angle Θ of about one hundred degrees with the first seam 114. In some embodiments, the angle Θ may vary within the stated range, and different instances of the angle Θ may vary from each other.

Figure 9:
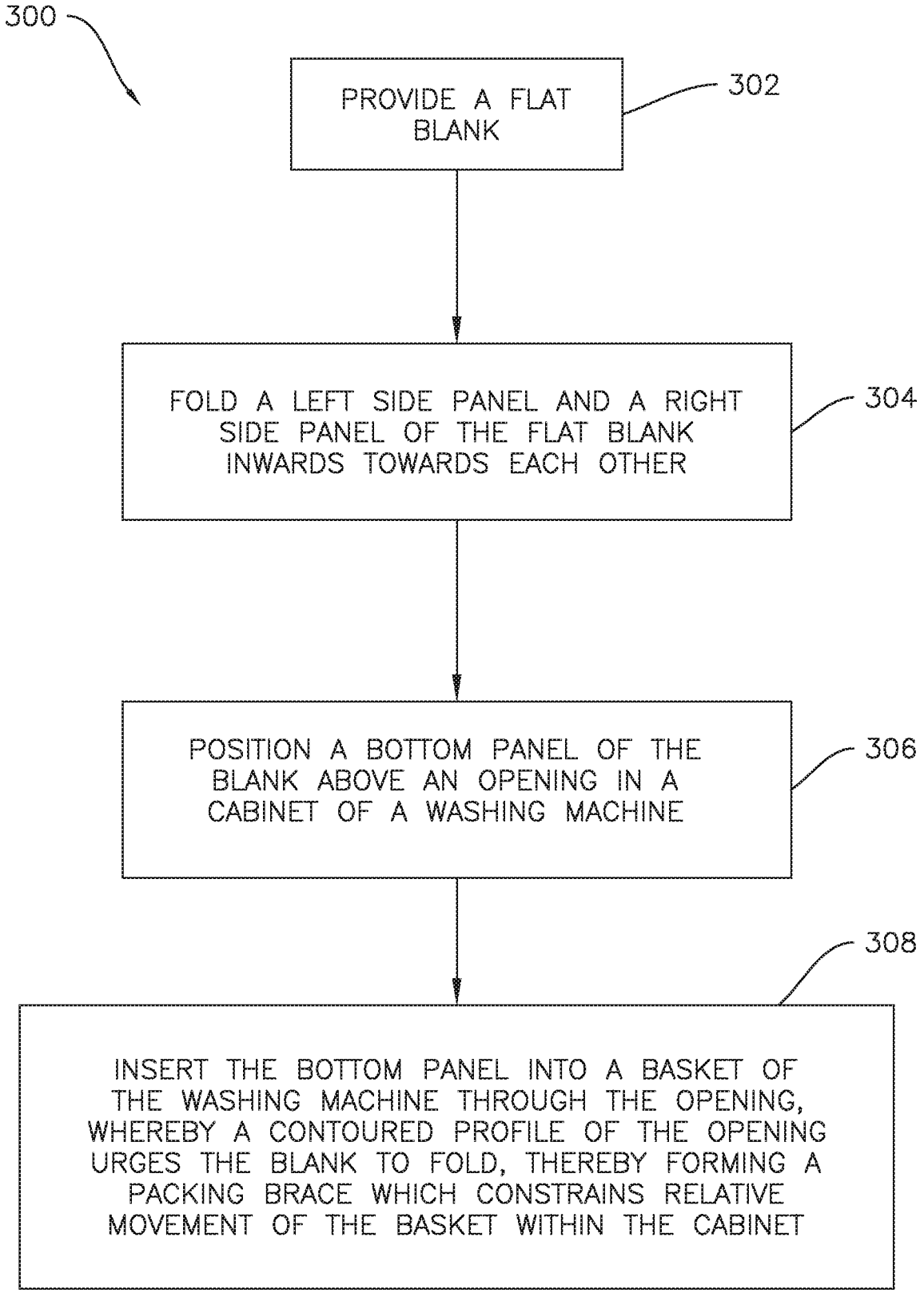
FIG. 9 is a flow chart diagrammatically illustrating a method of forming a packaging brace for a washing machine appliance according to one or more additional example embodiments of the present subject matter.

As mentioned above, embodiments of the present disclosure also include methods of forming a packaging brace 102 for a washing machine appliance 10, such as the example method 300 illustrated in FIG. 9. As illustrated in FIG. 9, the method 300 may include an initial step 302 of providing a flat blank. For example, the flat blank which is provided in step 302 may be the blank 100 in a flat condition illustrated in FIGS. 1 through 8 and described above. Thus, the flat blank provided in step 302 may include the bottom panel 104, the left side panel 106, the back panel 108, the right side panel 110, and the front panel 112. The flat blank provided in step 302 may further include the first corner segment 122, the second corner segment 128, the third corner segment 134, and the fourth corner segment 140.

The method 300 may also include a step 304 of folding the left side panel 106 and the right side panel 110 of the flat blank 100 inwards towards each other, followed by a step 306 of positioning the bottom panel 104 above an opening in a cabinet of the washing machine, such as the opening 24 in the cabinet 12 of the washing machine appliance 10 described above.

The method 300 may further include a step 308 of inserting the bottom panel 104 into a basket of the washing machine through the opening, such as the wash basket 20 described above. As a result of such insertion, a contoured profile of the opening 24 and/or the top panel 22 or other portion of the cabinet 12 proximate the opening 24 urges the blank 100 to fold. The blank 100 may be urged to fold such that the fifth seam 124 and the sixth seam 126 are generally aligned with each other and in contact with each other to define a first corner 194 of the packaging brace 102, the seventh seam 130 and the eighth seam 132 are generally aligned with each other and in contact with each other to define a second corner 196 of the packaging brace 102, the ninth seam 136 and the tenth seam 138 are generally aligned with each other and in contact with each other to define a third corner 198 of the packaging brace 102, and the eleventh seam 142 and the twelfth seam 144 are generally aligned with each other and in contact with each other to define a fourth corner 200 of the packaging brace 102.

In some embodiments, e.g. where the washing machine appliance 10 includes the agitator 23, inserting the bottom panel 104 into the basket 20 may include passing the agitator 23 through the aperture 154 defined in the bottom panel 104.

In some embodiments, e.g., where the flat blank further includes a left side flap, a back flap, a right side flap opposite the left side flap, and a front flap opposite the back flap, e.g., the flaps 146, 148, 150, and 152 described above, the method 300 may further include closing a lid (e.g., lid 30) of the washing machine appliance after the contoured profile of the opening urges the blank to fold. After closing the lid, an outer edge 147 of the left side flap 146, an outer edge 149 of the back flap 148, an outer edge 151 of the right side flap 150, and an outer edge 153 of the front flap 152 are each in contact with an inner surface (e.g., the inner surface 32) of the lid of the washing machine appliance when the lid is closed.

The blank 100 described herein, as well as the packaging brace 102 formed therefrom and related methods of forming the packaging brace 102, provide several advantages as will be recognized by those of ordinary skill in the art. For example, one such advantage is that the packaging brace 102 may be formed from a single blank 102 without needing to join additional parts or cut or otherwise separate or divide one or more sub-parts of the blank 100. As another example, the flat blank 100 may not include any tabs and may be configured to form the packaging brace 102 without using any tabs or adhesives. Furthermore, the foregoing example advantages are provided by way of illustration only and are not limiting of the present invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A flat blank for forming a packaging brace for a washing machine appliance, the flat blank comprising:

a bottom panel;

a left side panel directly joined to a left side of the bottom panel at a first seam;

a back panel directly joined to a back side of the bottom panel at a second seam;

a right side panel positioned opposite the left side panel, the right side panel directly joined to a right side of the bottom panel at a third seam;

a front panel positioned opposite the back panel, the front panel directly joined to a front side of the bottom panel at a fourth seam;

a first corner segment directly joined to the left side panel at a fifth seam and directly joined to the back panel at a sixth seam, the first corner segment configured to define a first corner of the packaging brace when the flat blank is folded such that the fifth seam and the sixth seam are generally aligned with each other and in contact with each other;

a second corner segment directly joined to the back side panel at a seventh seam and directly joined to the right side panel at an eighth seam, the second corner segment configured to define a second corner of the packaging brace when the flat blank is folded such that the seventh seam and the eighth seam are generally aligned with each other and in contact with each other;

a third corner segment directly joined to the right side panel at a ninth seam and directly joined to the front panel at a tenth seam, the third corner segment configured to define a third corner of the packaging brace when the flat blank is folded such that the ninth seam and the tenth seam are generally aligned with each other and in contact with each other; and a fourth corner segment directly joined to the front panel at an eleventh seam and directly joined to the left side panel at a twelfth seam, the fourth corner segment configured to define a fourth corner of the packaging brace when the flat blank is folded such that the eleventh seam and the twelfth seam are generally aligned with each other and in contact with each other;

wherein the first corner, the second corner, the third corner, and the fourth corner of the packaging brace are configured to contact an opening in a cabinet of the washing machine appliance at a first set of four contact points and to contact a basket of the washing machine appliance at a second set of four contact points.

2. The flat blank for forming a packaging brace of claim 1, further comprising a left side flap, a back flap, a right side flap opposite the left side flap, and a front flap opposite the back flap, wherein an outer edge of the left side flap, an outer edge of the back flap, an outer edge of the right side flap, and an outer edge of the front flap are each configured to contact an inner surface of a lid of the washing machine appliance when the flat blank is folded.

3. The flat blank for forming a packaging brace of claim 1, wherein the flat blank is configured to form the packaging brace without any tabs or adhesives.

4. The flat blank for forming a packaging brace of claim 1, wherein the flat blank is configured to form the packaging brace by folding the flat blank and installing the flat blank in the washing machine appliance without cutting the flat blank.

5. The flat blank for forming a packaging brace of claim 1, further comprising an aperture defined in the bottom panel, the aperture configured to receive an agitator of the washing machine appliance.

6. The flat blank for forming a packaging brace of claim 1, further comprising a first relief opening at an intersection of the bottom panel, the left side panel, the back panel, and the first corner segment, a second relief opening at an intersection of the bottom panel, the back panel, the right side panel, and the second corner segment, a third relief opening at an intersection of the bottom panel, the right side panel, the front panel, and the third corner segment, and a fourth relief opening at an intersection of the bottom panel, the left side panel, the front panel, and the fourth corner segment.

7. The flat blank for forming a packaging brace of claim 1, wherein the first corner segment is bifurcated by a first score line, the second corner segment is bifurcated by a second score line, the third corner segment is bifurcated by a third score line, and the fourth corner segment is bifurcated by a fourth score line.

8. The flat blank for forming a packaging brace of claim 1, further comprising a first relief opening positioned in the first corner segment, a second relief positioned in the second corner segment, a third relief positioned in the third corner segment, and a fourth relief opening positioned in the fourth corner segment.

9. The flat blank for forming a packaging brace of claim 1, wherein each contact point of the first set of four contact points is positioned directly above a corresponding contact point of the second set of four contact points.

10. The flat blank for forming a packaging brace of claim 1, wherein the fifth seam, the sixth seam, the seventh seam, the eighth seam, the ninth seam, the tenth seam, the eleventh seam, and the twelfth seam are each linear.

11. The flat blank for forming a packaging brace of claim 1, wherein the fifth seam, the sixth seam, the seventh seam, the eighth seam, the ninth seam, the tenth seam, the eleventh seam, and the twelfth seam are each curvilinear.

12. The flat blank for forming a packaging brace of claim 1, wherein the fifth seam forms an angle of about one hundred degrees with the first seam, the sixth seam forms an angle of about one hundred degrees with the second seam, the seventh seam forms an angle of about one hundred degrees with the second seam, the eighth seam forms an angle of about one hundred degrees with the third seam, the ninth seam forms an angle of about one hundred degrees with the third seam, the tenth seam forms an angle of about one hundred degrees with the fourth seam, the eleventh seam forms an angle of about one hundred degrees with the fourth seam, and the twelfth seam forms an angle of about one hundred degrees with the first seam.

13. A method of forming a packaging brace for a washing machine appliance, comprising:

providing a flat blank, the flat blank comprising:

a bottom panel;

a left side panel directly joined to a left side of the bottom panel at a first seam;

a back panel directly joined to a back side of the bottom panel at a second seam;

a right side panel positioned opposite the left side panel, the right side panel directly joined to a right side of the bottom panel at a third seam;

a front panel positioned opposite the back panel, the front panel directly joined to a front side of the bottom panel at a fourth seam;

a first corner segment directly joined to the left side panel at a fifth seam and directly joined to the back panel at a sixth seam;

a second corner segment directly joined to the back side panel at a seventh seam and directly joined to the right side panel at an eighth seam;

a third corner segment directly joined to the right side panel at a ninth seam and directly joined to the front panel at a tenth seam; and a fourth corner segment directly joined to the front panel at an eleventh seam and directly joined to the left side panel at a twelfth seam;

folding the left side panel and the right side panel of the flat blank inwards towards each other;

positioning the bottom panel above an opening in a cabinet of the washing machine; and inserting the bottom panel into a basket of the washing machine through the opening, whereby a contoured profile of the opening urges the blank to fold, whereby the fifth seam and the sixth seam are generally aligned with each other and in contact with each other to define a first corner of the packaging brace, the seventh seam and the eighth seam are generally aligned with each other and in contact with each other to define a second corner of the packaging brace, the ninth seam and the tenth seam are generally aligned with each other and in contact with each other to define a third corner of the packaging brace, and the eleventh seam and the twelfth seam are generally aligned with each other and in contact with each other to define a fourth corner of the packaging brace;

whereby the first corner, the second corner, the third corner, and the fourth corner of the packaging brace are in contact with the opening in the cabinet of the washing machine appliance at a first set of four contact points and in contact with the basket of the washing machine appliance at a second set of four contact points.

14. The method of claim 13, wherein the packaging brace is formed without using any tabs or adhesives.

15. The method of claim 13, wherein the packaging brace is formed without cutting the flat blank.

16. The method of claim 13, wherein positioning the bottom panel above an opening in a cabinet of the washing machine comprises aligning an aperture defined in the bottom panel with an agitator of the washing machine appliance, and wherein inserting the bottom panel into the basket comprises passing the agitator through the aperture defined in the bottom panel.

17. The method of claim 13, wherein the first corner segment is bifurcated by a first score line, the second corner segment is bifurcated by a second score line, the third corner segment is bifurcated by a third score line, and the fourth corner segment is bifurcated by a fourth score line, and wherein each corner segment folds inward at the respective score line when the contoured profile of the opening urges the blank to fold.

18. The method of claim 13, wherein the flat blank further comprises a left side flap, a back flap, a right side flap opposite the left side flap, and a front flap opposite the back flap, and wherein the method further comprises closing a lid of the washing machine appliance after the contoured profile of the opening urges the blank to fold, whereby an outer edge of the left side flap, an outer edge of the back flap, an outer edge of the right side flap, and an outer edge of the front flap are each in contact with an inner surface of the lid of the washing machine appliance when the lid is closed.

19. The method of claim 13, wherein each contact point of the first set of four contact points is positioned directly above a corresponding contact point of the second set of four contact points.

* * * * *